US007591766B2

(12) United States Patent
Ellis

(10) Patent No.: US 7,591,766 B2
(45) Date of Patent: Sep. 22, 2009

(54) UNIVERSAL EXERCISE MACHINE

(76) Inventor: James A. Ellis, 134 Indian Hanna Rd., West Chester, PA (US) 19382

( * ) Notice: Subject to any disclaimer, the term of this patent is extended or adjusted under 35 U.S.C. 154(b) by 315 days.

(21) Appl. No.: 11/827,495

(22) Filed: Jul. 12, 2007

(65) Prior Publication Data

US 2009/0017994 A1 Jan. 15, 2009

(51) Int. Cl.
*A63B 69/06* (2006.01)

(52) U.S. Cl. ..... 482/72; 482/73; 482/908

(58) Field of Classification Search ..... 482/51–53, 482/57, 62, 70–73, 110, 121, 135, 144, 908
See application file for complete search history.

(56) References Cited

U.S. PATENT DOCUMENTS 4,421,307 A 12/1983 Cunnington et al.
5,295,931 A * 3/1994 Dreibelbis et al. ..... 482/72
6,802,798 B1 10/2004 Zeng
6,817,968 B2 * 11/2004 Galbraith et al. ..... 482/72
6,923,749 B1 8/2005 Smith
7,381,164 B2 * 6/2008 Smith et al. ..... 482/72
2002/0187879 A1 12/2002 Ball et al.

FOREIGN PATENT DOCUMENTS

GB 321362 A 11/1929
GB 1059611 A 2/1967
WO WO 97/14475 A1 4/1997

* cited by examiner

*Primary Examiner*—Glenn Richman
(74) *Attorney, Agent, or Firm*—Reed Smith LLP; Maryellen Feehery Hank

(57) ABSTRACT

The present invention is an exercise device of the rowing machine type, which may impose both flexion and extension forces against motion of a user with respect to the seat and/or arms of the exercise device. Rotation of the seat about a pitch axis may be provided to allow a user to impose forces against the seat pan more comfortably in opposition to seat travel flexion resistance, while rotationally free grips may allow the user to maintain proper orientation of the hands and wrists during exercise using the exercise device. Other improvements are discussed in the detailed description of the invention above.

25 Claims, 15 Drawing Sheets

UNIVERSAL EXERCISE MACHINE

BACKGROUND

The present invention relates to exercise machines, and in particular to rowing style exercise machines adapted to provide both flexion and extension resistance to a rowing motion, while providing optimized positioning of hands, arms, and legs during such flexion and extension resistance.

Prior art exercise rowers 100 such as the one shown in FIG. 1, typically provide resistance while a user of the device is extending his or her legs, such that resistance is provided as a seat 102 travels away from a foot rest 104, creating a leg press exercise. Additionally, rowing arms 106 are provided such that the user can exercise his or her arms and shoulders by drawing the handles 108 of the arms 106 into the user's chest, while the legs are being extended, to exercise not only the legs (in an extension mode), but the arms and shoulders as well. Many present rowers only load the arms 106, such that the leg press action is used to pull the arms rearward, while the arms of a user concurrently pull the arms further rearward.

These exercise devices utilize a seat 106 that remains substantially fixed in orientation relative to the axis of travel 110 of the seat, as well as arms 106 that rotate around one or two axis 112, 114. The rotational axes of the arms are about an axis 116 perpendicular to the axis of travel of the seat, and about an axis 118 parallel to the axis of travel 110 of the seat. The handles 108 of the arms 106 remain fixed to the ends of the arms 106, and accordingly constrain the motion of the hands of a user, requiring significant motion of the hands about the wrists.

This constraint of the motion of the hands forces the transference of forces from the arms 106 of the exercise machine 100 through the wrists while the wrists are mis-aligned with the hands, creating adverse stresses in the wrists of the users. These forces may thus limit the resistance forces that a user can safely impose through the arms, as well as create adverse health impacts.

These rowing machines 100 are further limited by the fixed motion of the seat 102 relative to axis of travel 110 of the seat. A seat back 120 may be provided, such that when the user extends his or her legs, the seat back 120 allows a user to apply force to the seat back 120 to force the seat 102 to travel with the buttocks of the user away from the foot rests 104. Return forces are negligible, since no seat flexion resistance is provided, such the fixed orientation of the seat 102 does not hamper return of the seat 102 along the seat travel axis 110 as a user draws his or her legs in for a next stroke. Should resistance forces be imposed as the seat 102 travels forward, a user is likely to slide off the seat 102, as the resistance to such motion is applied to the seat 102.

The issues addressed above limit the ability to effectively use a rowing style machine in which resistance is imposed in both flexion and extension motions, and accordingly, the present invention is disclosed to address these and other limitations of existing exercise equipment.

SUMMARY OF THE INVENTION

The present invention may be embodied in an exercise device providing both extension and flexion resistance forces to seat travel motion relative to a front cross member. The exercise device may have a main beam, the main beam having a seat slidably engaged thereto. The seat may include a seat pan, with the seat being able to slide along the main beam along a seat travel axis, the seat travel axis extending between the front end and the rear end of the main beam. The seat may have a seat pan axis substantially perpendicular to the seat pan. The exercise device may also have a front cross member, with the front cross member being engaged to the main beam at the front of the main beam end. The exercise device may also be provided with first and second foot rests engaged to the front cross member, and a seat extension resistance device engaged to the seat such that motion of the seat away from the front end is impeded by resistance imposed by the seat extension resistance device. The exercise device may also be provided with a seat flexion resistance device engaged to the seat such that motion of the seat towards the front end is impeded by the seat flexion resistance device. The seat may be rotatable around a pitch axis perpendicular to the seat travel axis. The seat may be configured to rotate about said pitch axis to reduce the acute angle between the seat pan axis and the seat travel axis when the seat traverses towards the front end, as well as to rotate about the pitch axis to increase the acute angle between the seat pan axis and the seat travel axis when the seat traverses away from end front end.

In another embodiment, the present invention may be embodied in an exercise device providing both extension and flexion resistance forces to rowing arm motion. The exercise device may have a main beam, the main beam having a seat slidably engaged thereto, with the seat able to slide along said main beam along a seat travel axis, with the main beam having a first end and a second end. A front cross member may also be provided, with the front cross member being engaged to the main beam at the first main beam end. First and second foot rests may be engaged to the front cross member. First and second rowing arms may also be provided. The first and second rowing arms may be rotatable around an axis substantially perpendicular to the seat travel axis. A rowing arm extension resistance device may be engaged to one or both of the arms such that motion of an upper extent of such arms towards the first end is impeded by resistance imposed by the rowing arm extension resistance device. A rowing arm flexion device may be engaged to either or both of the arms such that motion of an upper extent of an arm or both arms away from the first end is impeded by resistance imposed by the rowing arm flexion resistance device. The exercise device may also be provided with rotationally free handles located at an upper extent of such rowing arms. The rotationally free handles may allow grips to be mounted to the upper extents of the rowing arms to rotate around at least two axes to allow the hands of a user of the exercise machine to remain in a comfortable orientation relative to the upper extents of the rowing arms during motion of the rowing arms.

In another embodiment, instead of having rowing arms, the exercise device may have first and second horizontally suspended lines, each having a handle attached thereto. Said horizontal lines or tapes may have varying degrees of tension in them, such that the handles which are attached to the lines may have some vertical motion, depending on the amount of tension existing in the horizontal lines. The horizontal lines may be suspended at either end by tensioning devices which impart varying degrees of resistance to the lines as the lines are pulled from the tensioning devices. These tensioning devices also may take up or wind the horizontal lines when slack exists in the lines in order to maintain the tension in the lines. In this embodiment, a person using the exercise device may sit to travel along the main beam, between the horizontal lines such that the person may grasp the handles with both hands at a comfortable height and distance from his or her body. In addition, the horizontal lines may be long enough and the tensioning devices positioned such that a person using the exercise device may sit with legs fully flexed and arms fully extended (or legs and back fully extended and arms fully flexed) and still have a length of line left before the line meets any of the tensioning devices. In this embodiment, a person using the exercise device may engage resistance through pushing and pulling the handles attached to the horizontal lines while traveling fore and aft along the main beam.

DETAILED DESCRIPTION OF THE INVENTION

Figure 1:
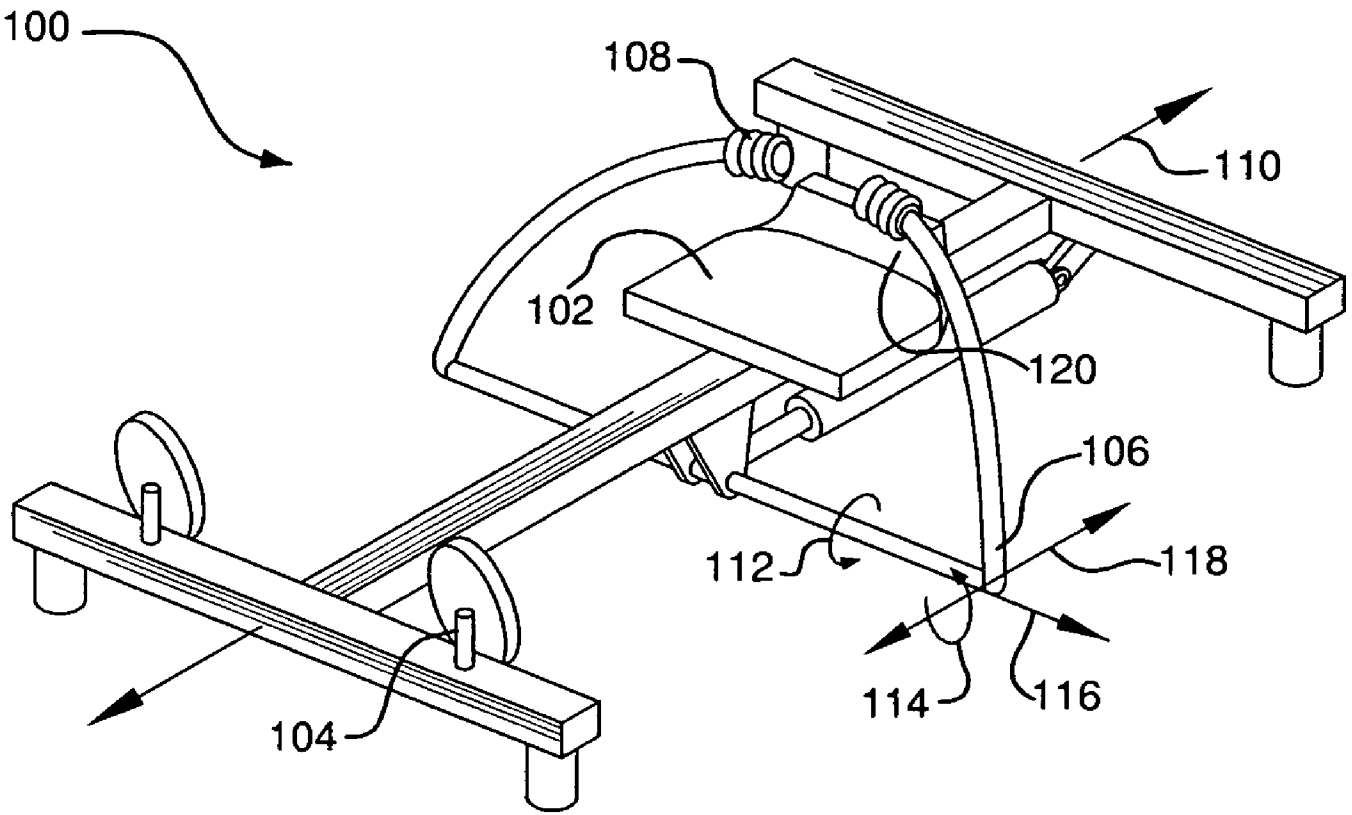
FIG. 1 illustrates an exercise machine as presently available, including resistance to extension motions of a user.
Figure 2:
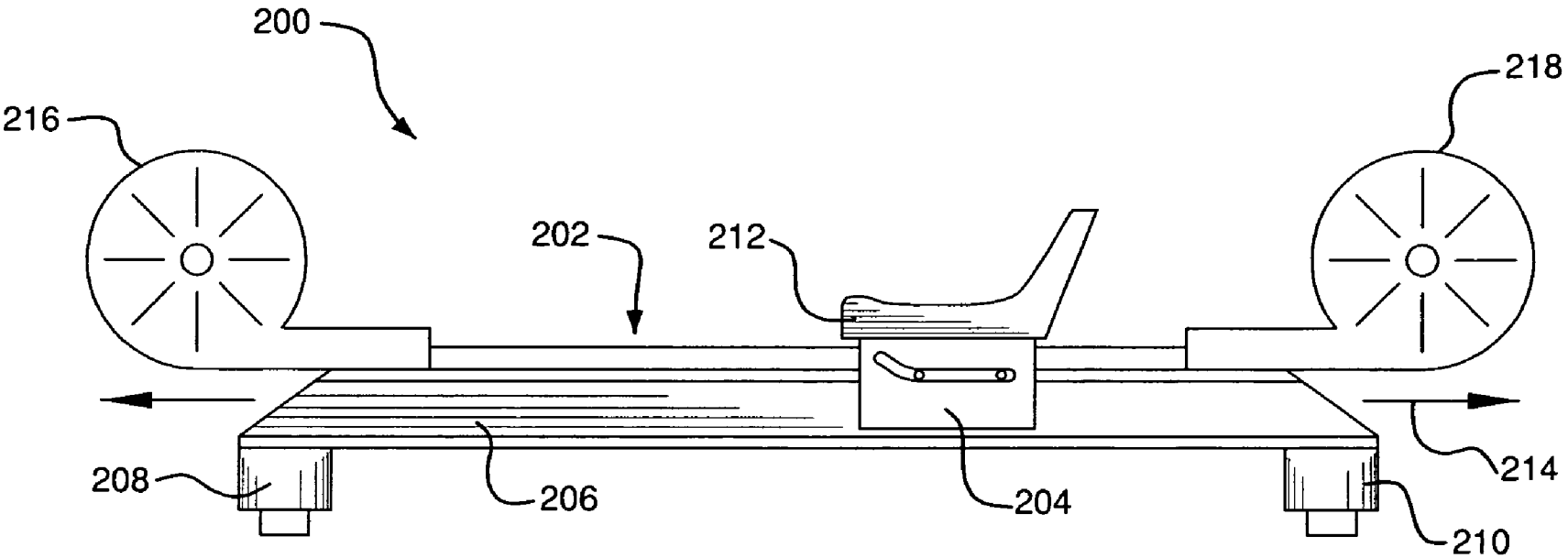
FIG. 2 illustrates the frame and seat of a notional exercise machine according to the present invention, shown in a side view.

As shown in the Figures, in which like numerals are used to identify like elements, there is shown an embodiment of the present invention. In FIG. 2, the frame 202 and seat traverse mechanism 204 are shown. The frame 202 may typically consist of a main beam 206 and a front cross member 208. A rear cross member 210 may be added for stability of the exercise device 200 when in use, as well as to provide structure for mounting resistance components for the exercise device 200.

A seat 212 may be mounted to a traverse mechanism 204, such that the seat 212 is able to slide along a seat travel axis 214 with a minimum amount of resistance. A seat extension resistance device 216 may be provided to impose resistance to travel of the seat 212 away from the front cross member 208 (referred to hereafter as seat extension motion, based on the extension of the legs of a user as a seat moves away from the front cross member.) A seat flexion resistance device 214 may be provided to impose resistance to travel of the seat 212 towards the front cross member 208 (referred to hereafter as seat flexion motion, based on the flexion of the legs of a user as a seat moves toward the front cross member.) The combination of the seat extension resistance device 216 and the seat flexion resistance device 218 provide resistance to travel of the seat 212 in both directions, creating a leg and buttocks curl exercise in addition to the conventional leg press exercise. Where a resistance device is capable of resisting travel of the seat 212 in both forward and aft directions, the seat extension resistance device and the seat flexion resistance device may be accomplished by a single device.

The seat extension resistance device may typically be a device which imposes resistance to travel of the seat along the seat travel axis, either as a result of position (i.e., resistance increases as distance away from the front cross member increases), as a result of seat travel speed, or as a constant resistance along the travel of the seat.

Position type resistance devices typically use a spring type force, i.e., wherein the force increases as a factor of the distance traveled, typically expressed as $F=kx$ (where Fig. force, K is a spring constraint, and x is the position). Speed type resistance devices typically use a fluid damper type of system, such that resistance is determined as a factor of speed of travel of the seat, or $F=cx$ (where c is the damping coefficient). Typical linear fluid dampener devices force liquid though an orifice as a means of increasing resistance, while rotary devices use a fan spinning within a viscous fluid to create a speed sensitive resistance force. The resistance force of linear motion fluid dampeners is typically modified by varying the size of the orifice that the fluid is forced through to increase or decrease the resistance. Alternately, speed based magnetic resistance units, such as that shown in U.S. Pat. No. 7,011,607 to Kolde et. al. may be used to create a speed dependant resistance. More complex devices are equally useable, such as magnetorheological resistance devices such as discussed in U.S. Pat. No. 5,816,372 to Carlson et. al. may be used. Constant resistance may typically be generated using a friction type resistance device, typically expressed as $F=c$. While this discussion is provided to aid in the understanding of the function of the present invention, the various devices available to provide resistance are well known in the art, and the use of resistance technologies not yet developed does not vary the function of the present invention.

In one embodiment, seat extension resistance device and the seat flexion resistance device generate resistance both as a function of distance traveled, as well as a function of seat travel speed. Devices which allow these resistances to be generated are commonly found on present rowing style exercise machines, including the ability to vary the initial force of the position based resistance (i.e., varying the constant component c in the force equation $F=k\times+c$.)

Where positional resistance is employed, the use of counter-vailing resistance devices must be considered, since forces applied to a seat to induce it to move towards the front cross member may balance out forces applied to a seat to induce it to move away from the front cross member. Such a balancing may create a balance point, typically at the midpoint of travel of the seat, such that no forces are applied to induce the seat to move in either direction at this balance point.

Constant force devices, such as braked disks or magnetic fans, thus have the advantage that no balance point is present through the travel of the seat, and force may be more easily generated by a single device, rather than requiring the use of opposing resistance devices (i.e., separate extension and flexion resistance devices.) Furthermore, such devices may be provided such that a clutch allows resistance to be imposed in only a single direction, i.e., such as when a string or tape is extended from the device, as well as a retraction device which automatically retracts the string or tape when force is released from the end of the string or tape. Accordingly, two devices opposing each other may be provided to allow for a smooth resistance in both directions, without concerns about balance points created by counter-opposing resistances.

Figure 3:
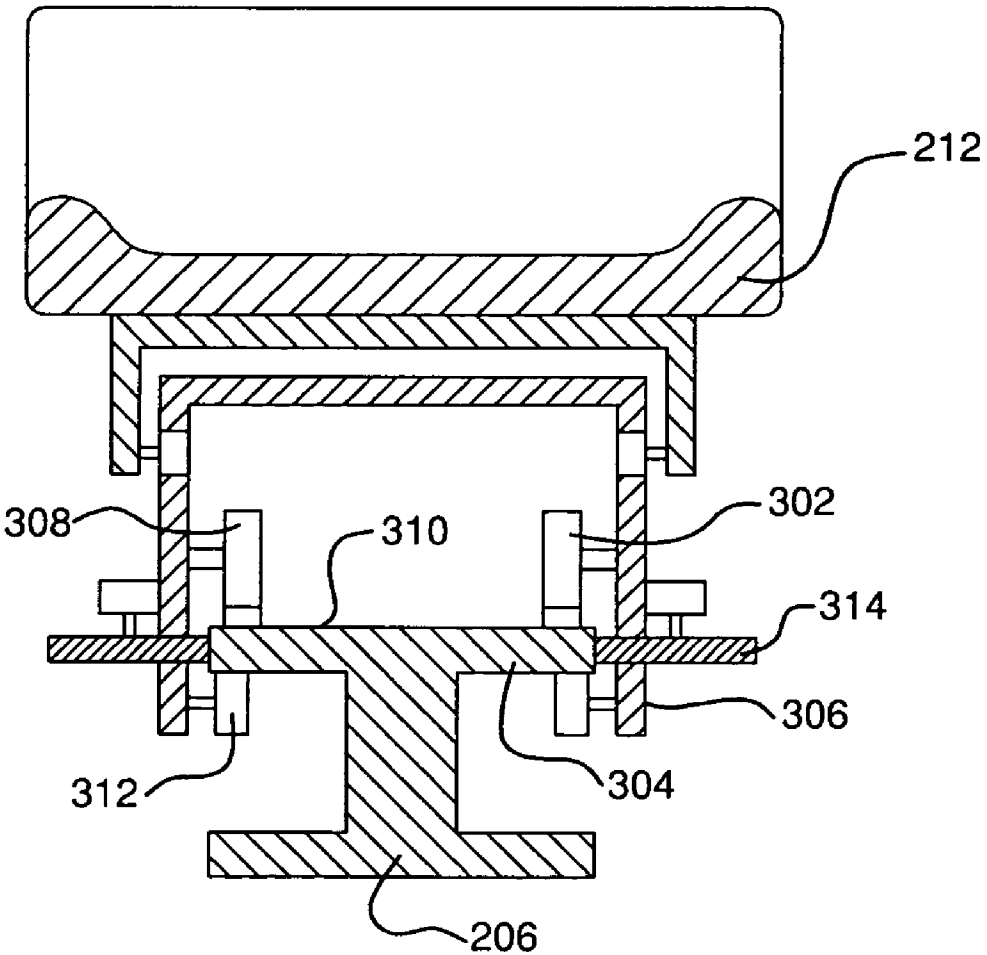
FIG. 3 illustrates the frame and seat of a notional exercise machine according to the present invention, shown in a cross-sectional end view to show the engagement between the seat travel block and the main beam.

Seat travel may be accomplished by mounting the seat 212 to the main beam 206 through the use of roller bearings 302 which engage a flange 304 on the main beam. Such a configuration is shown in FIG. 3. As shown, the seat 212 is mounted to a travel block 306, which rests on the main beam 206 via top rollers 308. The weight of a user occupying the seat 212 thus keeps the top rollers 308 in contact with the top surface 310 of the main beam 206. In order to prevent lifting of the seat, under-ride rollers 312 may be provided to hold the seat 212 in place against the main beam 206 even when the weight of a user is not applied at the seat 212. Finally, side rollers 314 may be provided to minimize motion of the seat travel block 306 laterally with respect to the main beam 206. Although the embodiment shown uses rollers, the same constraints to motion of the seat travel block may alternately be accomplished through the use of bearing surfaces, selected to minimize friction between the components, or though the use of linear bearings.

Figure 4:
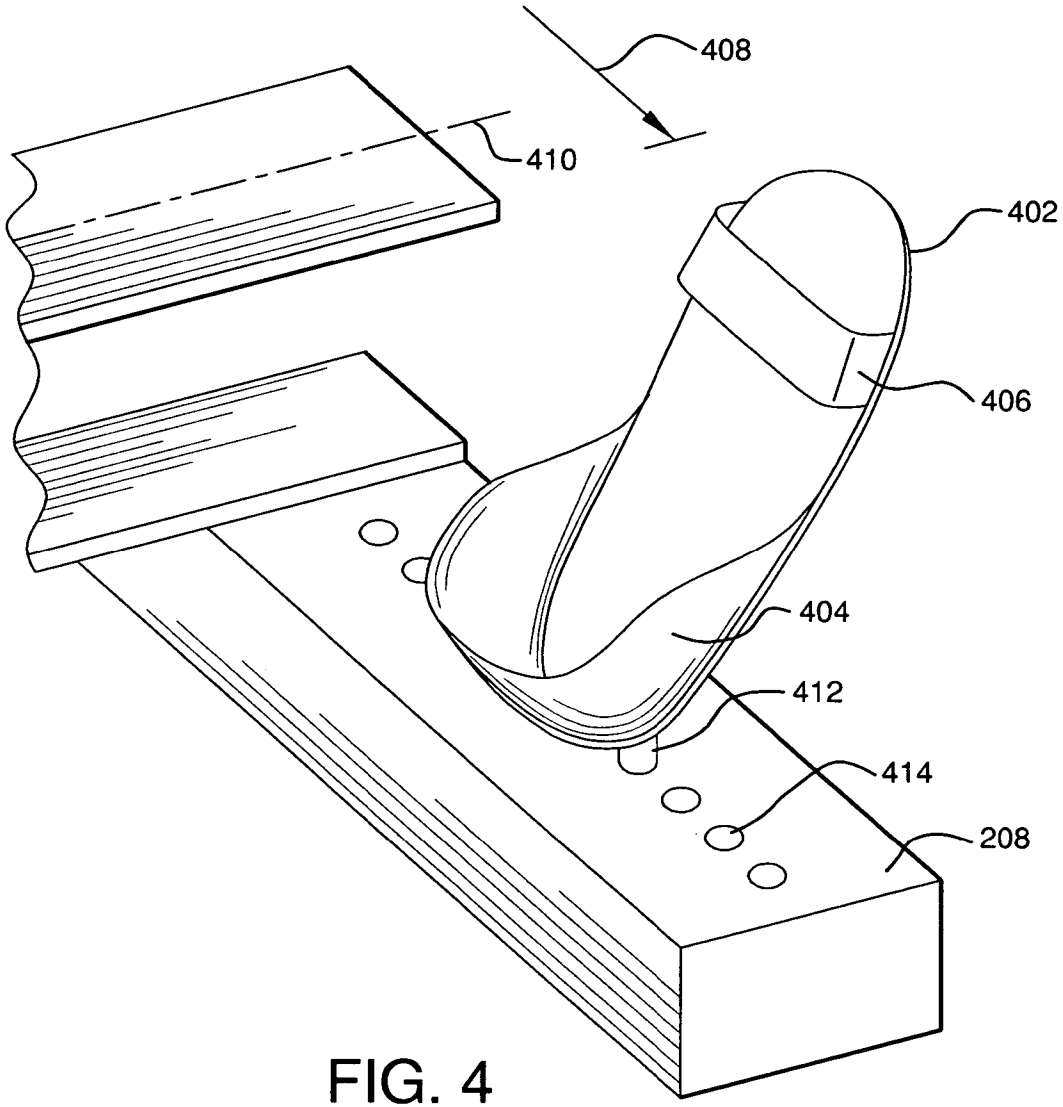
FIG. 4 illustrates a foot rest for a notional exercise machine according to the present invention, shown in an isometric view

As shown in FIG. 4, the front cross-member 208 of the exercise device 200 may be provided with foot rests 402, to allow the user of the device to bear against the front cross member 208 to react force to the cross member 208 during extension motions. The foot rests 402 may be provided with heel cups 404 to help support the feet of a user, primarily as a means of enhancing the comfort of the user during exercise. Foot restraints 406 may be provided to allow a user to pull against the front cross member 208 during flexion motions of the seat 212, especially where flexion resistance is being imposed upon the seat 212.

The foot rests 402 may optimally be constructed such that the spacing 408 between the foot rests 402 can be varied towards or away from the centerline 410 of the front cross member 208, as dictated by the preference of the user. The adjustability of the spacing 408 can be implemented such that discrete positions are established, such as through the structure shown in FIG. 4, or continuously, such as through the structure shown in FIG. 5.

In FIG. 4, mounting pins 412 are provided to allow individual left and right foot rests to be engaged to the front cross member 208 in through bores 414. Varying which through bores 414 are used establishes the foot rests 402 at different positions relative to the centerline 410 of the front cross member 208.

Figure 5:
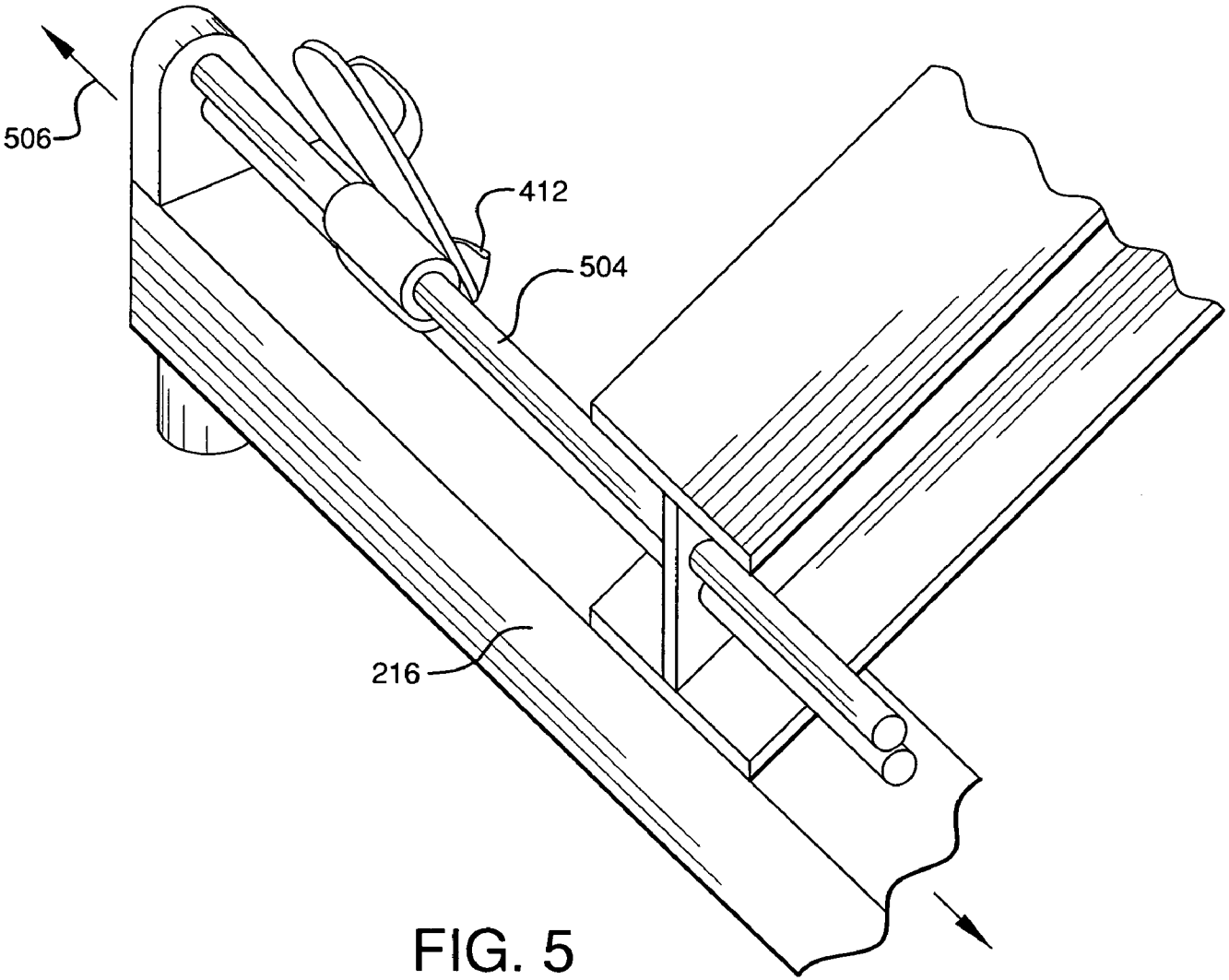
FIG. 5 illustrates a foot rest structure for the present invention, utilizing slide rods to allow continuous variation of the spacing between foot rests.

In FIG. 5, the individual foot rests 402 are mounted via linear bearings 502 or slides to one or more slide rods 504 which run parallel to the axis 506 of the front cross member 216. The use of linear bearings in conjunction with a single slide rod allows the foot rests to rotate around the axis of the slide rods, such that the feet of a user can move during exercise, especially as a function of the position of the seat (either close to the front cross member or translated away from the front cross member.) The use of multiple slide rods, such as is shown, constrains rotation of the feet rests, which may be preferable to individual users.

Figure 6:
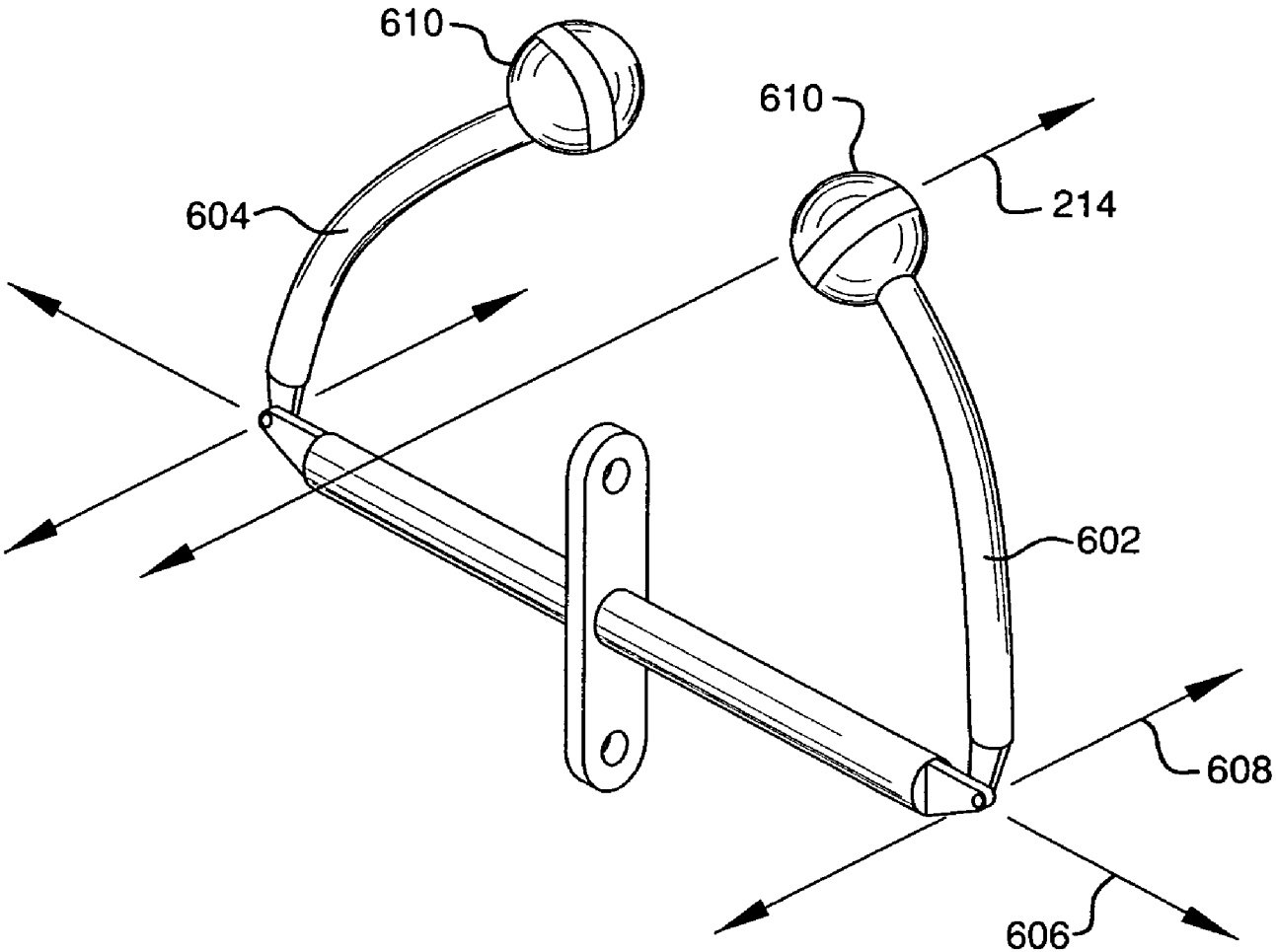
FIG. 6 illustrates a rowing arm mechanism for the present invention, shown in an isometric view.

FIG. 6 illustrates arm mechanisms as used on a rowing machine according to the present invention. Each arm 602, 604 is allowed to rotate about two axis, a first axis 606 perpendicular to the seat travel axis 214, and a second axis 608 parallel to the seat travel axis 214. Rotation about these two axes allows a user to vary the spacing between the handles 610 as the user prefers, continuously during motion of the arms.

Figure 7:
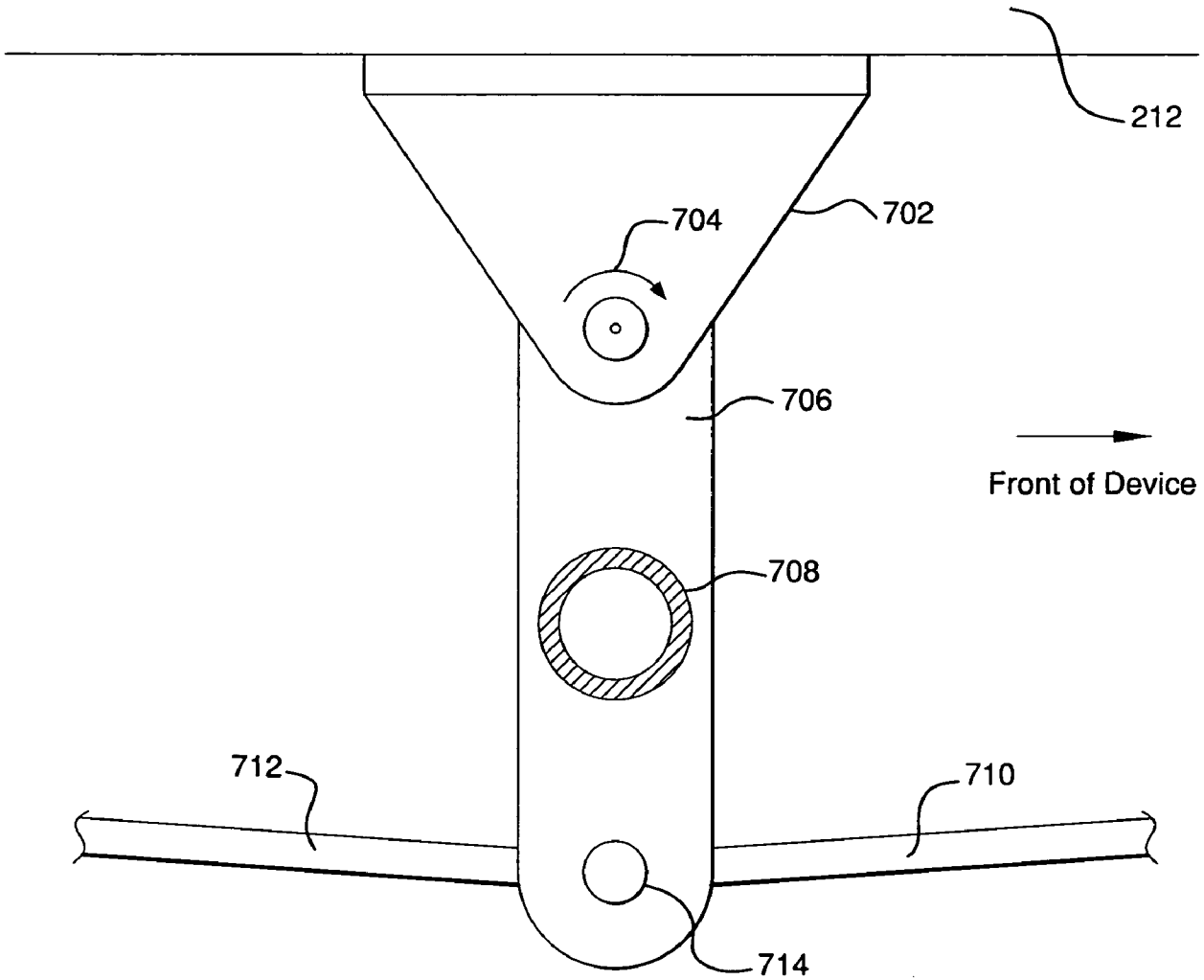
FIG. 7 illustrates a rowing arm mechanism connecting rowing arms to a main beam, shown in a side view.

Rotation about an axis perpendicular to the seat travel axis may be implemented by constructing a mechanism such as shown in FIG. 7. A main beam clevis 702 may be provided, with a rotational joint 704 formed between the clevis and a swing plate 706. Arm cross-tubes 708 (shown in cross-section) may be mounted to opposing sides of the swing plate 706. The swing plate 706 may be formed from either a plate or a boxed structure.

Arm extension (pushing the grips towards the front cross member) resistance and arm flexion (pulling the grips towards the user) resistance devices (710, 712 respectively) may be provided to create resistance to motion of the arms both towards the front cross member, and away from the front cross member. These resistance devices may be consistent with the resistance devices used to create seat extension resistance and seat flexion resistance. A pin 714 may be provided between the swing plate 706 and the arm extension resistance devices 710, 712, such that extension of a users arm causes the swing plate 706 to rotate in a clockwise direction when viewed from the right side of the device with the front cross member to the right. The other end of the arm extension resistance device may be mounted to the main bean, or to a rear cross member (not shown), to resolve the forces generated by the resistance device. The junction between the other end of the arm extension resistance device and the main beam or rear cross member may also be provided with a clevis joint, to allow rotation of the arm extension resistance device needed to prevent unduly constraining the arm extension resistance device. An arm flexion resistance device may also be provided, such that resistance to rotation of the swing plate is provided when the swing plate is rotated in a counterclockwise motion, as viewed from the right side of the device, with the front cross member to the right.

Figure 8:
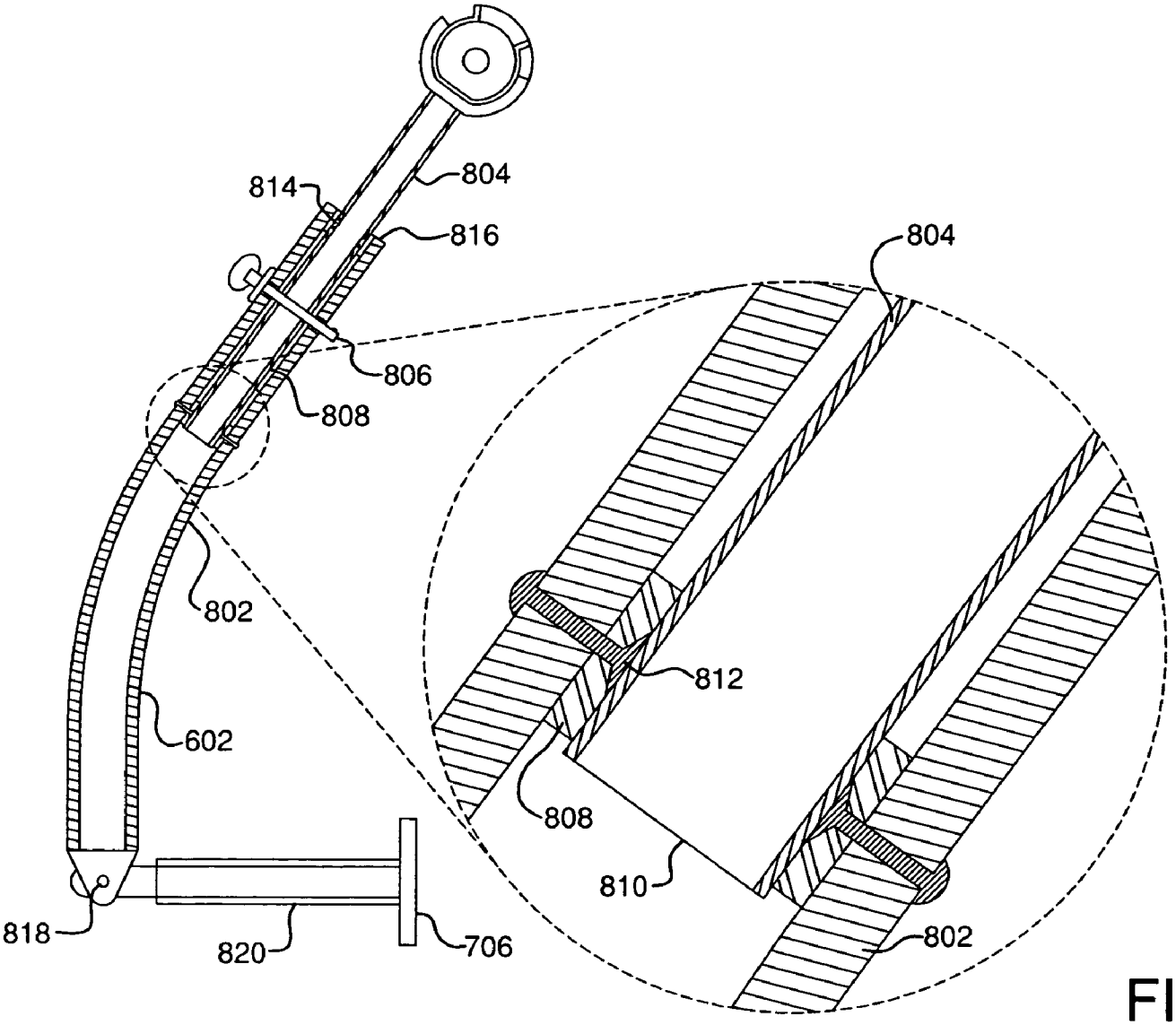
FIG. 8 illustrates a rowing arm for the present invention, shown in cross-section, illustrating arm length adjustability.

As shown in FIG. 8, the arms, shown in cross section, may be constructed such that the lengths of the individual arms may be adjusted to suit an individual user. Such adjustability may be accomplished by forming each arm 602 from a lower section 802 and an upper section 804, with a sliding engagement provided to join the combined pieces. A length fixing feature, such as a pit pin 806 extending through an overlapped area of the lower section 802 and the upper section 804 may be provided to allow a user to fix the length of the arm. Alternately, the engagement of the upper section 804 and lower section 806 may be left in a condition to allow sliding between the upper section 804 and the lower section 806, such that the length of the arm may be varied during a rowing motion imposed by a user of the exercise device. The joint 808 must also be able to prevent rotation of the two pieces relative to each other, to allow forces imposed below the joint to be acted upon by the user, such as through the use of splined surfaces on the outer surface of the upper section 804 and the inner surface of the lower section 806. Tolerance of rotation at the joint obviates any resistance force being applied to the user of the device. Accordingly, as shown, the arm sections 804, 806 may be formed from square tubing such that rotation of the upper arm portion is constrained when the upper section 804 is inserted in the lower section 806.

Slide blocks may be provided to reduce the friction between the upper and lower arm portions when the upper arm portion slides in or out of the lower arm portion. A first slide block 808 may extend around a lower end 810 of the upper section 804 portion near its end 810, with the first slide block fixed 812 to the lower end 810 of the upper section 804, with a second slide block 814 fixed to the inner surface of the lower section 806, adjacent to the upper end 816 of the lower section 806. With such an embodiment, the slide blocks 808, 814 will reduce friction between the arm sections 802, 804 as the upper section 802 slides within the lower section 806.

Additionally, the rotation of the arms may be implemented by providing a pin joint 818 between the lower section 806 and the arm cross tube 820, such that the lower section 806 is able to rotate about an axis parallel to the seat travel axis at the lower extent of the arms. This rotational freedom allows the user to adjust the spacing between the upper extents of the arms by rotating the arms in or out during a rowing cycle. Furthermore, the ability to vary the engagement of the upper arm portion in the lower arm portion allows the upper extents of the arms to be maintained in a comfortable position relative to the user of the exercise device.

Figure 9:
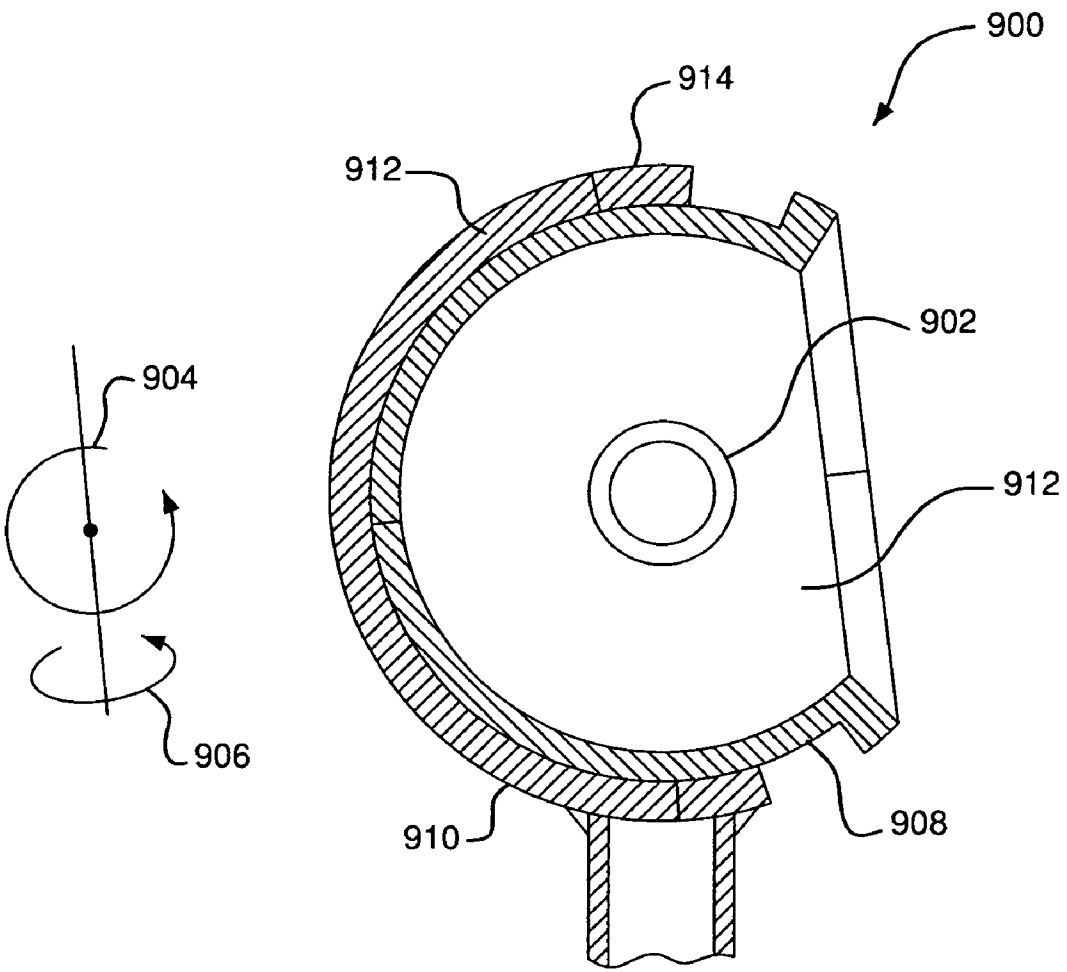
FIG. 9 illustrates one embodiment of a rotationally free grip for the present invention, shown in a cross-sectional view.

As shown in FIG. 9, the arms of the device may be provided with rotationally free handles 900. The rotationally free handles 900 allow the orientation of the hands of a user to change during motion of the arms, such that the user can vary the orientation of his or her hands to limit the bending of the wrist as desired by the user during use of the exercise device. The rotationally free handles may be formed from as a spherical bearing, to allow rotation of a grip 902 about at least two axes 904, 906, such that the hands of the user may be reoriented to maintain an optimal orientation for imposing forces against the grip 902 of the rotationally free handles 900.

Rotationally free handles may be constructed such as shown in cross section in FIG. 9. The rotationally free handles may be formed from an open spherical shell 908 within an open spherical shell 910 type of socket joint, such that where the openings are aligned, a user can insert a hand into the core 912 of the rotationally free handle 900 to hold onto a grip 902. The inner and outer spheres 908, 910 may be formed from a back hemispherical portion 912 joined to a front portion 914 to ease manufacture of the inner and outer spheres. The inner and outer spheres 908, 910 may be formed from plastic or metallic materials, recognizing strength requirements. The sliding surface between the inner sphere and the outer sphere may be provided with a friction reduction feature, such as a Teflon coating to either the outer surface of the inner sphere, or applied to the inner surface of the outer sphere.

Figure 10:
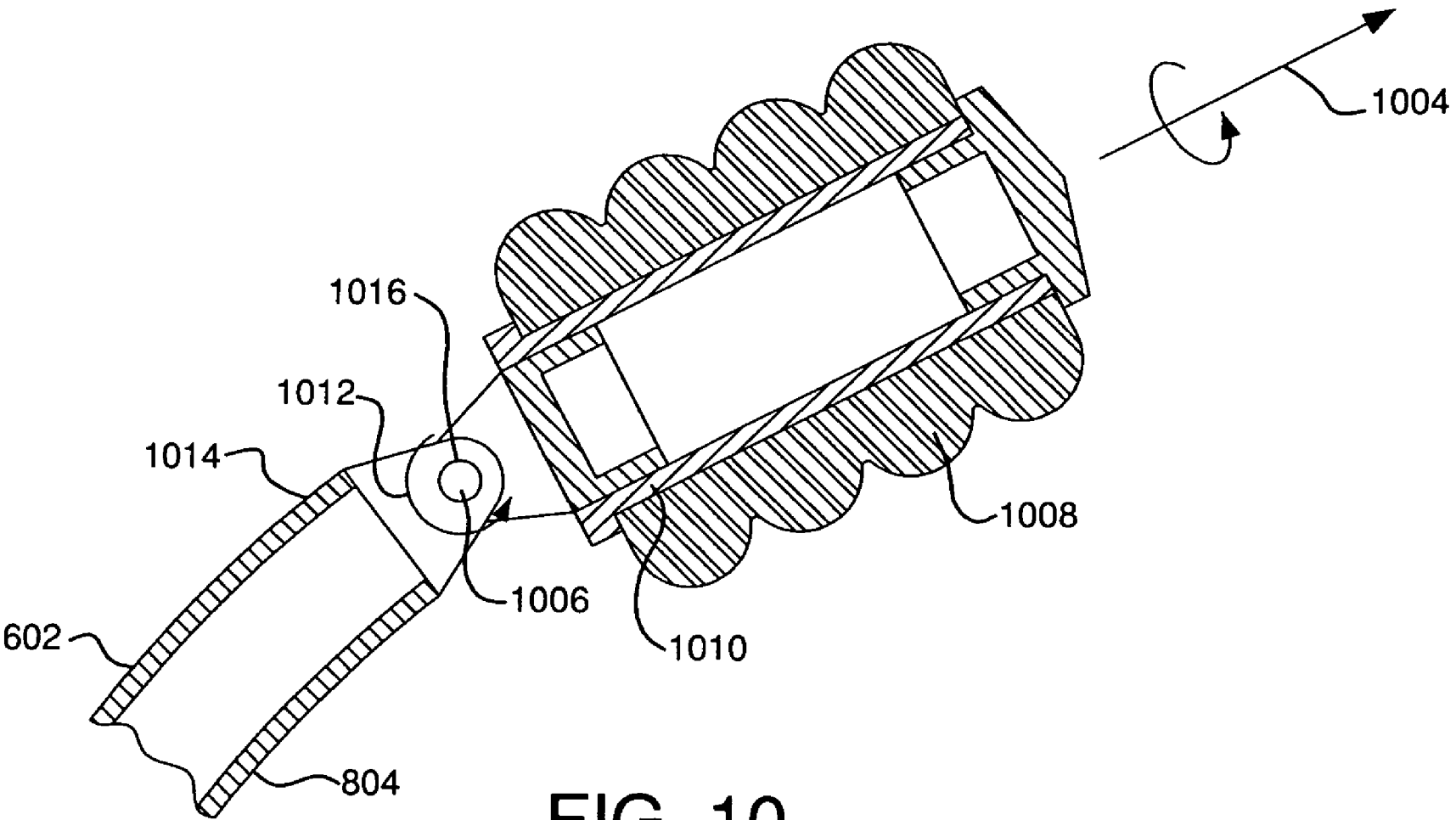
FIG. 10 illustrates an alternate embodiment of the rotationally free grips for the exercise machine of the present invention, also shown in a cross-sectional view.

An alternate embodiment of rotationally free handles is shown in cross section in FIG. 10, in which the grip 1002 are able to rotate about the long axis 1004 of the grips 1002 as well as about an axis 1006 perpendicular to the long axis of the grip 1002. The grip may be formed as a cylindrical shape 1008 around a center post 1010, with the cylindrical shape 1008 free to rotate about the center post 1010. A single rotational degree of freedom 1012 may be created between the center post 1010 and the upper extent 1014 of an upper section 804 of an arm through the use of a pin joint 1016 between the center post 1010 and the upper extent 1014 of the rowing arm 602. The pin joint 1016 may be able to rotate about the grip roll axis 1006 perpendicular to the grip axis 1004, and such that the grip roll axis 1006 is substantially perpendicular to the seat travel axis (not shown in Figure) when the arms 602 are in a neutral position. Orientation of this axis must be considered, since the use of the pin joint 1016 may cause the orientation of the grips 1008 to have a slight adverse orientation at the extents of travel of the arms. Rotation about a third axis may be provided, i.e., about a pitch axis, however the addition of this degree of freedom may hamper the ability of the user of the exercise machine to impose forces against the grips without requiring the user to maintain the grips in a desired orientation without having to control the orientation with forces supplied by the user. Alternately, the addition of this third degree of freedom may result in additional exercise benefit by working the muscles of the users wrists, as the user holds the grips in the proper orientation while imposing forces against the grips.

Figure 11:
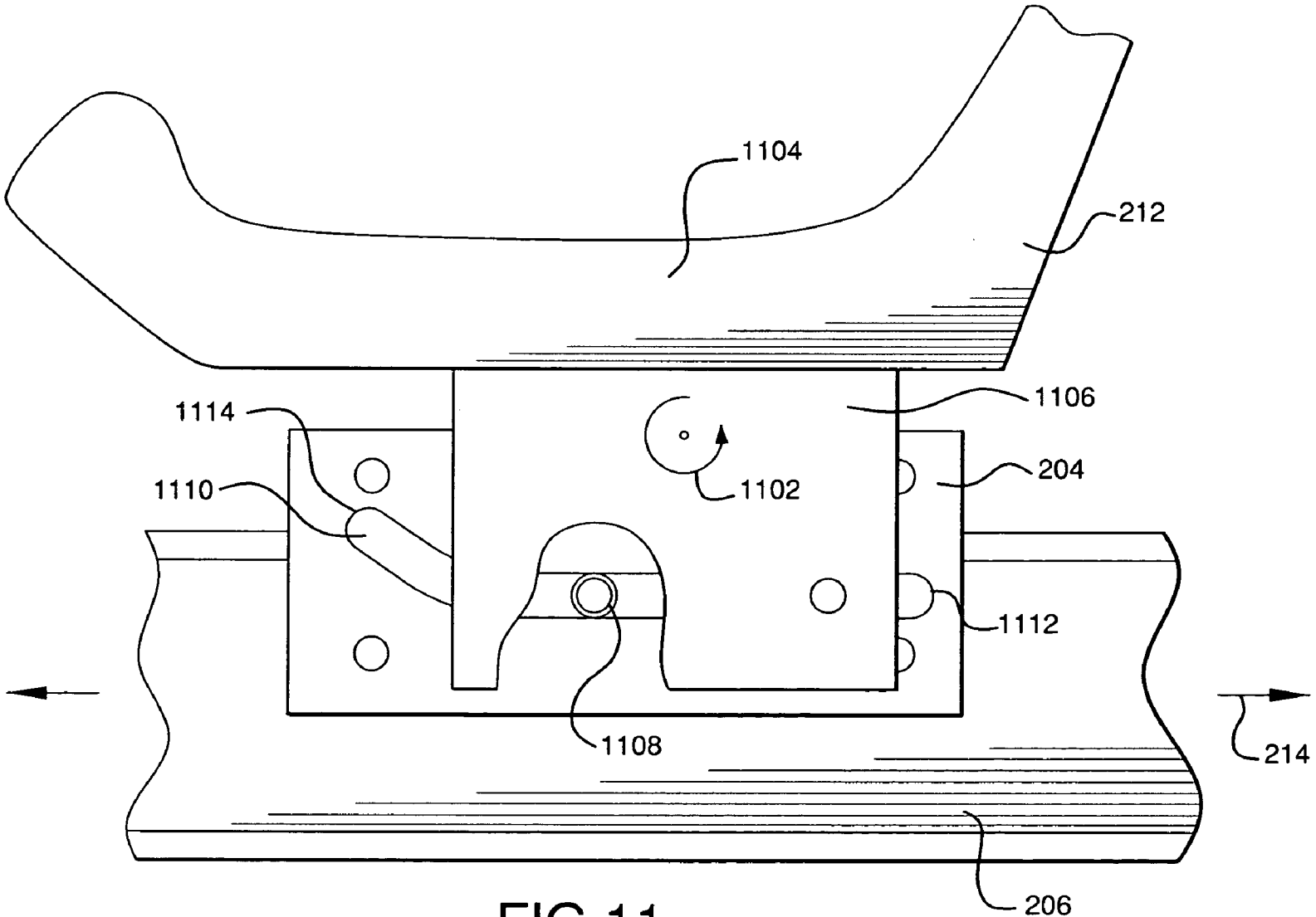
FIG. 11 illustrates a notional seat rocker mechanism for an exercise machine according to the present invention, shown in a side view, with a partial cross-section to illustrate the roller and arcuate slot.

As shown in FIG. 11, the seat 212 may additionally be provided with a rotational degree of freedom 1102 relative to the seat travel axis 214 to allow a rocking motion, to allow the seat pan 1104 to be rotated to enhance the ability of a user to apply force to the seat 212 to force the seat to move closer to the front cross member when flexion resistance is imposed upon the seat. The mechanism may comprise an upper seat block 1106 mounted to the seat traverse block 204 through rollers 1108 located within an arcuate slot 1110 (shown in partial cross-section) or slots in the seat traverse block 204. The arcuate slot 1110 may be formed such that when the rollers 1108 are at a location 1012 at their farthest extent from the front cross member, the orientation is substantially parallel to the seat travel axis 214, but angled upward when the rollers are at a location 1014 at their closest distance from the front cross member, such that a force applied by a user perpendicular to the seat pan 1104 is not perpendicular to the force vector applied by a seat flexion resistance device.

Figure 12:
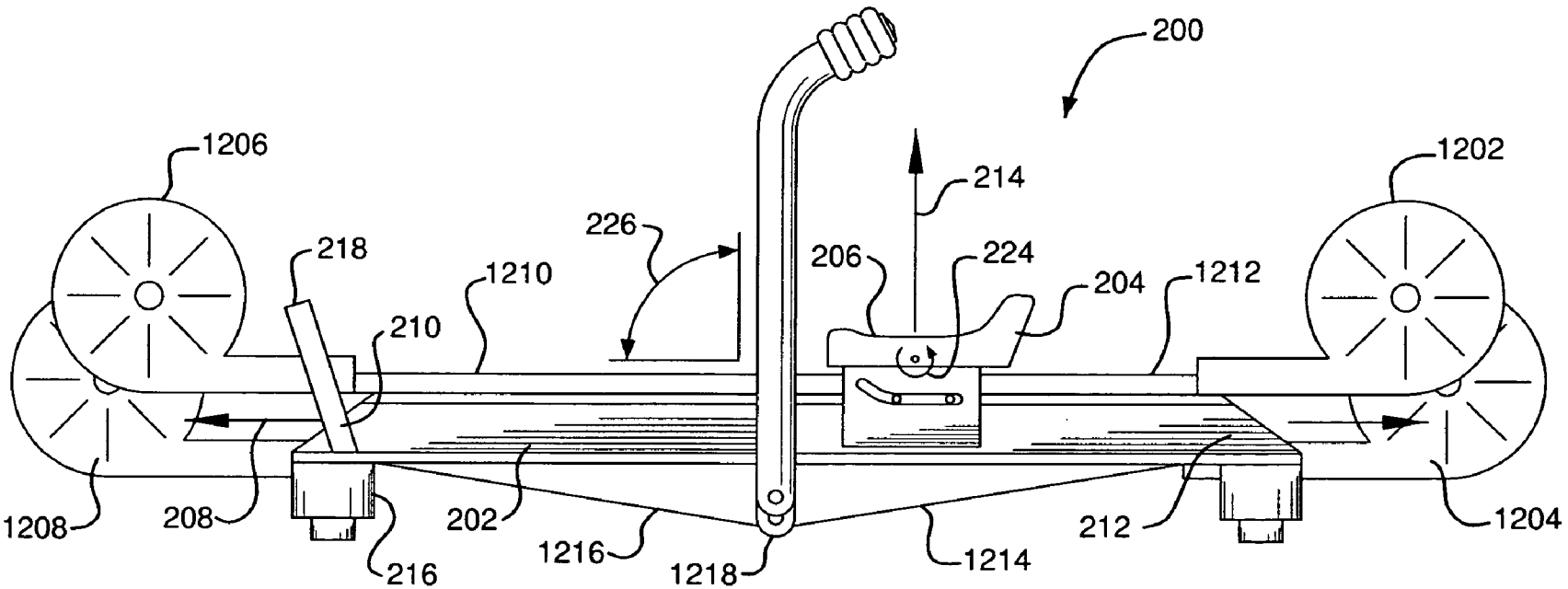
FIG. 12 illustrates an embodiment of the exercise machine of the present invention, utilizing fan/magnetic/friction resistance devices to provide constant resistance forces.

An alternate embodiment, using magnetic resistance devices such as those manufactured by Performance Fitness Systems and used in their R80 Series Exercise Devices, for the seat flexion and extension resistance forces, and the arm flexion and extension resistance forces is shown in FIG. 12. These devices provide a controllable amount of resistance based on both fan type and magnetically generated resistance in a single direction. The relevant motions as discussed above are maintained, with the fan/magnetic resistance devices substituted for the resistance devices as shown above. Four resistance forces may thus be imposed upon the user, seat flexion and extension, and arm flexion and extension, each created by a single fan/magnetic resistance unit 1202, 1204, 1206, 1208. Seat extension resistance may be imposed by a seat extension resistance unit 1206 attached to the front of the exercise device 200, and connected to the seat traverse mechanism 204 by the tape 1210 of the fan/magnetic resistance unit through one or more pulleys to align the tape. Seat flexion resistance may be imposed by a seat flexion resistance unit 1202 attached to the rear of the of the exercise device 200, and connected to the seat traverse mechanism 204 by the tape 1212 of the fan/magnetic resistance unit through one or more pulleys to align the tape. Arm flexion resistance may be imposed by an arm flexion resistance unit 1204 attached to the rear of the exercise device, and connected to the arm fulcrum by the tape 1214 of the fan/magnetic resistance unit through one or more pulleys to align the tape 1214. Arm extension resistance may be imposed by an arm extension resistance unit 1208 attached to the front of the exercise device, and connected to the arm fulcrum 1218 by the tape 1216 of the fan/magnetic resistance unit through one or more pulleys to align the tape 1216.

Figure 13:
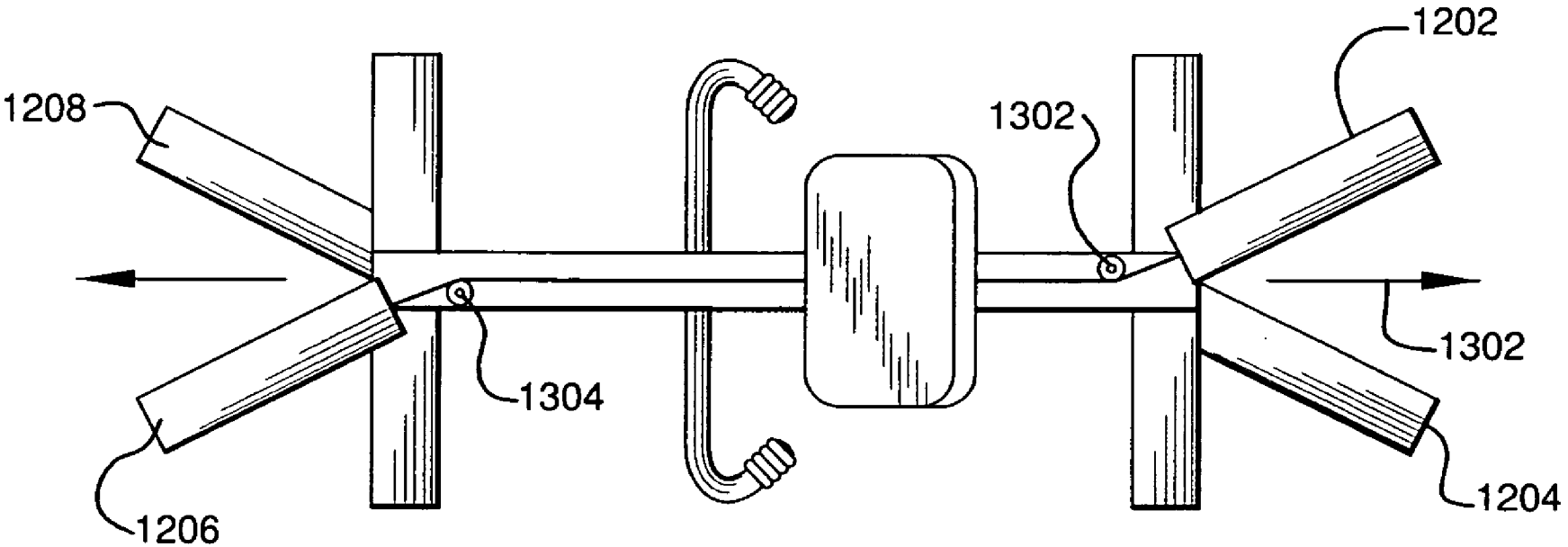
FIG. 13 illustrates an embodiment of the present device as shown in FIG. 12 utilizing pulleys to maintain symmetrical application of forces to a seat.

As shown in FIG. 13, the use of a single (as opposed to paired) seat flexion resistance 1202 and seat extension resistance 1206 units may result in the units not being located symmetrically with respect to the centerline 1302 of the exercise device 200. As it is preferable to apply the resistance forces along the centerline, pulleys 1302, 1304 may be used to align the tapes with respect to motion of the seat traverse mechanism. Similar pulleys may be implemented to align the arm resistance units.

Figure 14:
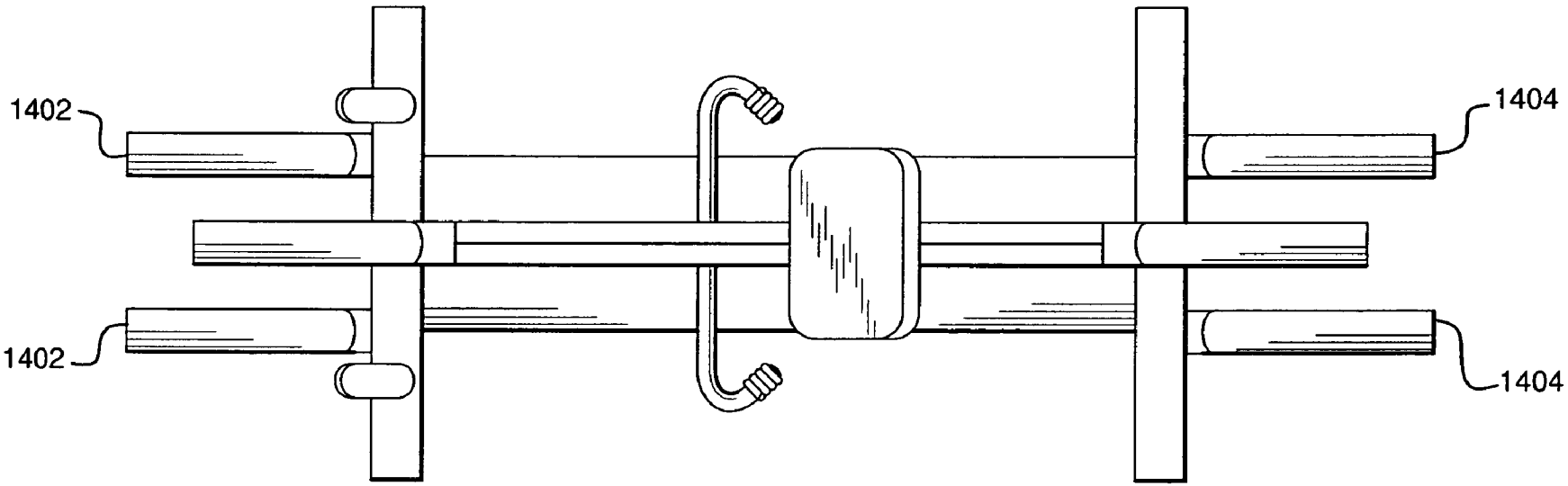
FIG. 14 illustrates an embodiment of the present device using paired arm motion resistance units to create symmetrical loading.

Alternately, as shown in FIG. 14, pairs of arm extension resistance devices 1402 or pairs of arm flexion resistance devices 1404 may be implemented to maintain symmetry of the forces imposed upon the seat traverse block 204 or arm fulcrum 706. Such a configuration allows the use of singled seat resistance members. The same considerations may alternately be applied to the seat resistance devices where singled arm resistance devices are used. The use of paired arm flexion and extension resistance devices allows greater forces to be applied to the arm motions, using the same resistance devices as used to resist seat traverse motion.

Figure 15:
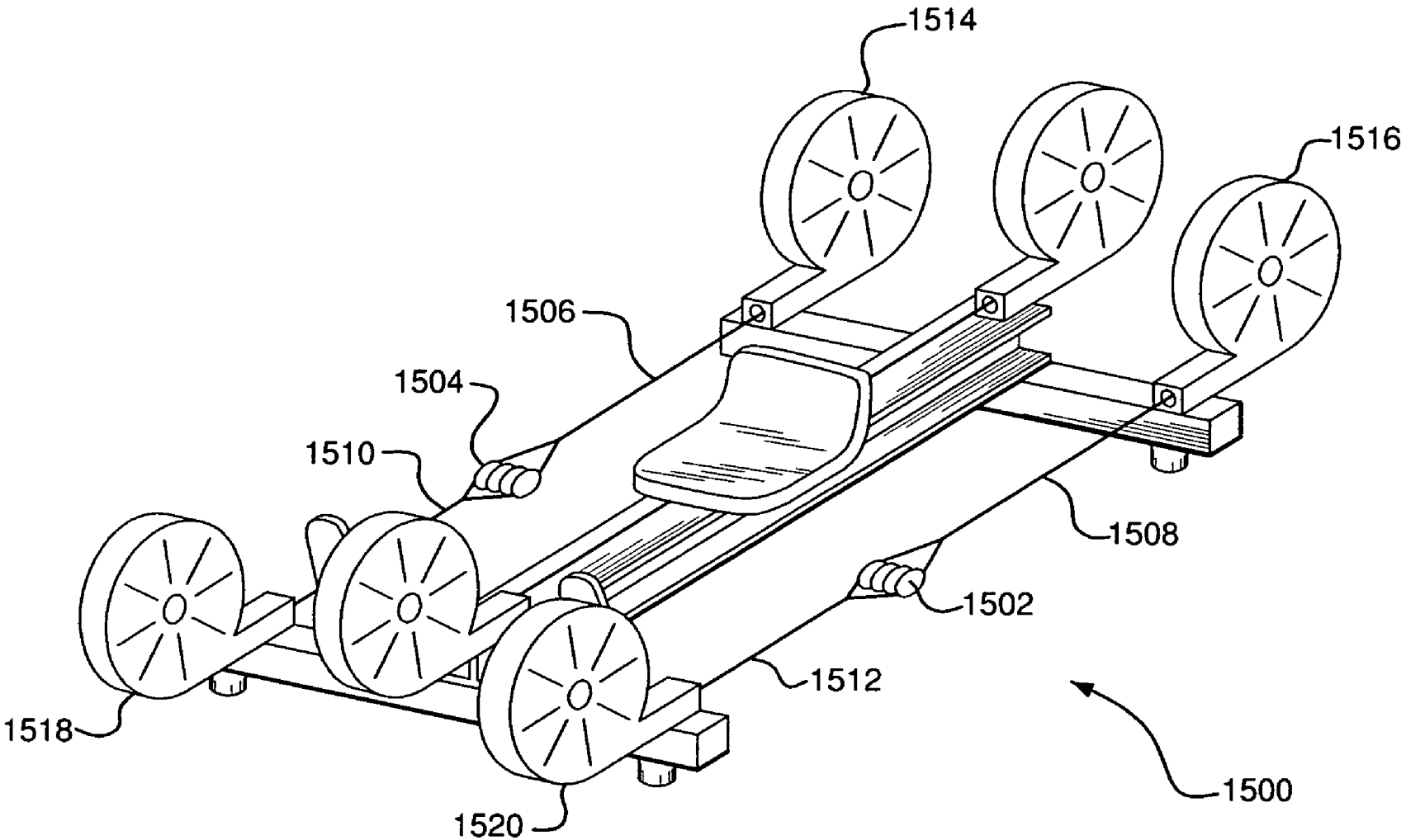
FIG. 15 illustrates an embodiment of the present device having a pair of handles connected directly to resistance device tapes to provide for minimally constrained exercise handles.

In an alternate embodiment, rather than utilizing rowing arms, the exercise device 1500 may have first and second handles 1502, 1504 connected to opposing tapes 1506, 1508, 1510, 1512 from resistance devices 1514, 1516, 1518, 1520. Such an embodiment is shown in FIG. 15. The use of paired arm resistance flexion devices 1518, 1520 and paired arm extension devices 1514, 1516 allows the tapes of the resistance units to be connected directly to handles 1502, 1504 such that a user of the device must additionally control the location of the handles 1502, 1504 during flexion or extension exercises. Furthermore, the flexibility of the tapes may allow the handles to function as rotationally free handles, such that a user may orient his or her hands in an optimum orientation. Preferably, the resistance devices may provide some initial tension, such that the handles themselves tend to stay tensioned between the opposing resistance devices.

As shown in FIG. 15, there may be four tensioning devices used to provide resistance for arm motions. Such tensioning devices may be spaced at an adjustable width apart on both the right and left hand sides in order to allow a person using the exercise device 1500 a comfortable space to move and sit in between the tapes 1506, 1508, 1510, 1512 when these tapes are drawn taut. The tensioning devices 1514, 1516, 1518, 1520 may also be placed at an adjustable height off the ground to allow the height of the horizontal lines to be at a height comfortable for a person using the exercise device to effectively grasp the handles and use the exercise device. The horizontal lines may be suspended by, pulled taut, or otherwise connected to, at either end, tensioning devices 1514, 1516, 1518, 1520 which impart an adjustable degree of resistance to the lines as the lines are pulled from the tensioning devices 1514, 1516, 1518, 1520. These tensioning devices 1514, 1516, 1518, 1520 also may take up or wind the horizontal lines when slack exists in the lines in order to maintain the tension in the lines in the horizontal direction. In this embodiment, a person using the exercise device may sit to travel along the main beam, between the horizontal lines such that the person may grasp the handles 1502, 1504 with both hands at a comfortable height and distance from his or her body. In addition, the tapes may be long enough and the tensioning devices 1514, 1516, 1518, 1520 positioned such that a person using the exercise device may sit with legs fully flexed and arms fully extended (or legs and back fully extended and arms fully flexed) and still have a length of line left before the line meets any of the tensioning devices 1514, 1516, 1518, 1520. In this embodiment, a person using the exercise device may engage resistance through pushing and pulling the handles attached to the horizontal lines while traveling for and aft along the main beam. The handles 1502, 1504 of the exercise device 1500 may be oriented in many different positions based upon how they are attached to the tapes, thus allowing a person to have many degrees of freedom in hand and arm position while using the exercise device 1500.

The tensioning devices in one of the embodiments of the present invention may be, as noted earlier, position type resistance devices, wherein the horizontal line is connected to an adjustable spring in each tensioning device. This may allow resistance to be experienced when both pulling and pushing the handles of the horizontal lines. In another embodiment, the horizontal lines may be a part of resistance devices using fluid damper systems, as noted earlier. Furthermore, in yet another embodiment, rotary resistance devices may be used, wherein the horizontal lines may be each connected to a flywheel or fan which spins in either air or a fluid to create a speed-sensitive resistance force, such as that shown in U.S. Pat. No. 4,875,674 to Dreissigacker et al. In each embodiment the resistance systems may be set up to allow adjustable degrees of resistance experienced by an exerciser doing both the pull and push motions. The resistance systems may all also be set up to allow the taking up of slack that may exist in the horizontal lines when the exerciser is pushing or pulling the horizontal lines, as the case may be, in order to maintain a minimum level of tension in the horizontal lines so as to prevent the exerciser's hands from being allowed to fall down too far. In another embodiment, as noted above, the horizontal lines may be tensioned by friction, speed-based magnetic, or magnetorheological resistance devices, which are well known in the art, and the use of resistance technologies not yet developed does not vary the function of the present invention.

Other variations and modifications of the present invention will be apparent to those of skill in the art, and it is the intent of the appended claims that such variations and modifications be covered. The particular values and configurations discussed above can be varied and are cited merely to illustrate a particular embodiment of the present invention and are not intended to limit the scope of the invention. It is contemplated that the use of the present invention can involve components having different characteristics as long as the principles of the invention are followed.

What is claimed is:

1. An exercise device providing both extension and flexion resistance forces to seat travel motion relative to a front cross member, said exercise device comprising:

a main beam, said main beam having a seat slidably engaged to said main beam, said seat having a seat pan, said seat able to slide along said main beam along a seat travel axis, said seat having a seat pan axis substantially perpendicular to said seat pan, said main beam having a first end and a second end;

a front cross member, said front cross member engaged to said main beam at said first main beam end;

first and second foot rests engaged to said front cross member;

a seat extension resistance device engaged to said seat such that motion of said seat away from said first end is impeded by resistance imposed by said seat extension resistance device; and a seat flexion resistance device engaged to said seat such that motion of said seat towards said first end is impeded by said seat flexion resistance device;

wherein said seat is rotatable around a pitch axis perpendicular to said seat travel axis;

wherein said seat rotates about said pitch axis to reduce the acute angle between said seat pan axis and said seat travel axis when said seat traverses towards said first end; and wherein said seat rotates about said pitch axis to increase the acute angle between the seat pan axis and the seat travel axis when said seat traverses away from said front cross member.

2. An exercise device according to claim 1, wherein said first and second foot rests are repositionable at varying distances from the centerline of the exercise device.

3. An exercise device according to claim 2, wherein said front crossmember comprises a plurality of vertical holes, and wherein said first foot rest comprises a first foot rest post, said first foot rest post being engageable within said vertical holes, and wherein said second foot rest comprises a second foot rest post, said second foot rest post being engageable within said vertical holes.

4. An exercise device according to claim 1, further comprising a pair of rowing arms, said rowing arms pivotably mounted to said main beam, said rowing arms further being connected to said exercise device by at least one arm flexion resistance unit, said at least one arm flexion resistance unit resisting motion of said rowing arms when said rowing arms are drawn towards a user.

5. An exercise device according to claim 1, further comprising a pair of handles connected to a pair of tapes, each of said tapes being connected to said exercise device by an arm flexion resistance device, said arm flexion resistance devices resisting motion of said handles when said handles are drawn towards a user.

6. An exercise device according to claim 5, wherein said handles are further connected to said exercise device by a pair of tapes, each of said tapes being connected to said exercise device by an arm extension resistance device, said arm extension resistance devices resisting motion of said handles when said handles are extended away from a user.

7. An exercise device according to claim 4, wherein said rowing arms comprise rotationally free handles located at an upper extent of said rowing arms, said rotationally free handles allowing grips mounted to said upper extents of said rowing arms to rotate around at least two axes to allow the hands of a user of the exercise machine to remain in a comfortable orientation relative to the upper extents of said rowing arms during motion of said rowing arms.

8. An exercise device according to claim 7, wherein said rowing arms each have a length, and wherein said rowing arm lengths are variable during motion of said rowing arms.

9. An exercise device according to claim 4, wherein at least one rowing arm is pivotably mounted to said main beam through a rowing arm fulcrum, said rowing arm fulcrum being rotatable about an axis perpendicular to said main beam through a first rotation point, said rowing arm fulcrum comprising an arm flexion resistance unit mount and an arm extension resistance mount, said arm flexion resistance unit mount being located a first distance from said first rotation point, said arm extension resistance mount being located a second distance from said first rotation point, said first distance being less than said second distance.

10. An exercise device according to claim 9, where said rowing arms comprise a first rowing arm and a second rowing arm, said first rowing arm pivotably mounted to said main beam, said second rowing arm pivotably mounted to said main beam, wherein the motion of said first rowing arm is not constrained with respect to motion of said second rowing arm.

11. An exercise device providing both extension and flexion resistance forces to rowing arm motion to a front cross member, said exercise device comprising:

a main beam, said main beam having a seat slidably engaged to said main beam, said seat able to slide along said main beam along a seat travel axis, said main beam having a first end and a second end;

a front cross member, said front cross member engaged to said main beam at said first main beam end;

first and second foot rests engaged to said front cross member;

first and second rowing arms, said first and second rowing arms being rotatable around an axis substantially perpendicular to said seat travel axis;

a rowing arm extension resistance device engaged to said arms such that motion of an upper extent of such arms towards said first end is impeded by resistance imposed by said rowing arm extension resistance device; and a rowing arm flexion resistance device engaged to said arms such that motion of an upper extent of such arms away from said first end is impeded by resistance imposed by said rowing arm flexion resistance device; and rotationally free handles located at an upper extent of such rowing arms, said rotationally free handles allowing grips mounted to said upper extents of said rowing arms to rotate around at least two axes to allow the hands of a user of the exercise machine to remain in a comfortable orientation relative to the upper extents of said rowing arms during motion of said rowing arms.

12. An exercise device according to claim 11, wherein motion of said seat away from said foot rests is resisted by a seat extension resistance unit.

13. An exercise device according to claim 12, wherein motion of said seat towards said foot rests is resisted by a seat flexion resistance unit.

14. An exercise device according to claim 13, wherein said seat comprises a seat pan, said seat having a seat pan axis substantially perpendicular to said seat pan, said main beam having a first end and a second end, said main beam having a main beam axis extending from said first end to said second end; and wherein said seat is rotatable around a pitch axis perpendicular to said seat travel axis;

wherein said seat rotates about said pitch axis to reduce the acute angle between said seat pan axis and said seat travel axis when said seat traverses towards said first end; and wherein said seat rotates about said pitch axis to increase the acute angle between the seat pan axis and the seat travel axis when said seat traverses away from said front cross member.

15. An exercise device according to claim 11, wherein said first and second foot rests are repositionable at varying distances from the centerline of the exercise device.

16. An exercise device according to claim 15, wherein said front crossmember comprises a plurality of vertical holes, and wherein said first foot rest comprises a first foot rest post, said first foot rest post being engageable within said vertical holes, and wherein said second foot rest comprises a second foot rest post, said second foot rest post being engageable within said vertical holes.

17. An exercise device according to claim 11, wherein said rowing arms each have a length, and wherein said rowing arm lengths are variable during motion of said rowing arms.

18. An exercise device according to claim 11, wherein at least one rowing arm is pivotably mounted to said main beam through a rowing arm fulcrum, said rowing arm fulcrum being rotatable about an axis perpendicular to said main beam through a first rotation point, said rowing arm fulcrum comprising an arm flexion resistance unit mount and an arm extension resistance mount, said arm flexion resistance unit mount being located a first distance from said first rotation point, said arm extension resistance mount being located a second distance from said first rotation point, said first distance being less than said second distance.

19. An exercise device according to claim 18, where said rowing arms comprise a first rowing arm and a second rowing arm, said first rowing arm pivotably mounted to said main beam, said second rowing arm pivotably mounted to said main beam, wherein the motion of said first rowing arm is not constrained with respect to motion of said second rowing arm.

20. An exercise device providing both extension and flexion resistance forces to rowing arm motion to a front cross member, said exercise device comprising:

a main beam, said main beam having a seat slidably engaged to said main beam, said seat able to slide along said main beam along a seat travel axis, said main beam having a first end and a second end;

a front cross member, said front cross member engaged to said main beam at said first main beam end;

first and second foot rests engaged to said front cross member;

first and second handles connected to first and second horizontal lines, said first and second handles and first and second horizontal lines being capable of traveling in the direction substantially parallel to said seat travel axis and capable of some vertical motion;

a rear resistance device engaged to each horizontal line such that motion of each horizontal line towards said first end is impeded by resistance imposed by said rear resistance device; and a front resistance device engaged to said horizontal line such that motion of each horizontal line away from said first end is impeded by resistance imposed by said front resistance device; and wherein said handles of said horizontal lines are rotationally free handles allowing motion in at least one axis to allow the hands of a user of the exercise machine to remain in a comfortable position during motion of said horizontal lines.

21. An exercise device according to claim 20, wherein motion of said seat away from said foot rests is resisted by a seat extension resistance unit.

22. An exercise device according to claim 21, wherein motion of said seat towards said foot rests is resisted by a seat flexion resistance unit.

23. An exercise device according to claim 22, wherein said seat comprises a seat pan, said seat having a seat pan axis substantially perpendicular to said seat pan, said main beam having a first end and a second end, said main beam having a main beam axis extending from said first end to said second end; and wherein said seat is rotatable around a pitch axis perpendicular to said seat travel axis;

wherein said seat rotates about said pitch axis to reduce the acute angle between said seat pan axis and said seat travel axis when said seat traverses towards said first end; and wherein said seat rotates about said pitch axis to increase the acute angle between the seat pan axis and the seat travel axis when said seat traverses away from said front cross member.

24. An exercise device according to claim 20, wherein said first and second foot rests are repositionable at varying distances from the centerline of the exercise device.

25. An exercise device according to claim 24, wherein said front crossmember comprises a plurality of vertical holes, and wherein said first foot rest comprises a first foot rest post, said first foot rest post being engageable within said vertical holes, and wherein said second foot rest comprises a second foot rest post, said second foot rest post being engageable within said vertical holes.

* * * * *